US006746297B2

(12) United States Patent
Robjent et al.

(10) Patent No.: US 6,746,297 B2
(45) Date of Patent: Jun. 8, 2004

(54) TOY BUILDING CONSTRUCTION SET

(75) Inventors: Frederick B. Robjent, Orchard Park, NY (US); Robert M. Goszewski, Depew, NY (US); David M. DuBois, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/630,360

(22) Filed: Jul. 29, 2003

(65) Prior Publication Data

US 2004/0082257 A1 Apr. 29, 2004

Related U.S. Application Data

(60) Provisional application No. 60/399,651, filed on Jul. 29, 2002.

(51) Int. Cl.[7] ..... A63H 33/08

(52) U.S. Cl. ..... 446/108; 446/120; 446/122; 446/124

(58) Field of Search ..... 446/85, 105, 108, 446/128, 111–114, 119–122, 124, 126

(56) References Cited

U.S. PATENT DOCUMENTS

| | | | | |
|---|---|---|---|---|
| 732,384 A | | 6/1903 | Thomsen | |
| 797,640 A | | 8/1905 | Thompson | |
| 1,437,867 A | * | 12/1922 | Sixta | 446/127 |
| 1,492,560 A | * | 5/1924 | Fisher | 446/105 |
| 1,569,066 A | | 1/1926 | Beiger | |
| 1,619,101 A | | 3/1927 | Chase | |
| 1,898,297 A | | 2/1933 | Fox | |
| 1,955,194 A | | 4/1934 | Leake | |
| 2,143,667 A | | 1/1939 | Troiel | |
| 2,315,463 A | | 3/1943 | Tingley et al. | |
| 2,407,927 A | * | 9/1946 | Hayden | 446/125 |
| 2,600,900 A | * | 6/1952 | McNeill | 446/110 |
| 3,020,601 A | | 2/1962 | Stambaugh et al | |
| 3,295,225 A | | 1/1967 | Sodergren | |
| 3,415,007 A | | 12/1968 | Höwe | |
| 3,526,054 A | | 9/1970 | Raman | |
| 3,571,965 A | | 3/1971 | Gibb | |
| 3,902,291 A | | 9/1975 | Zucht | |
| 3,996,693 A | | 12/1976 | Walmer | |
| 4,107,869 A | | 8/1978 | Abrams | |
| 4,193,221 A | * | 3/1980 | Beck | 446/105 |
| 4,195,437 A | | 4/1980 | Ace | |
| 4,199,894 A | | 4/1980 | Fischer | |
| 4,227,337 A | | 10/1980 | Murray et al. | |
| 4,270,302 A | | 6/1981 | Dandia | |
| 4,306,371 A | | 12/1981 | Walmer et al. | |
| 4,306,372 A | | 12/1981 | Lin | |
| 4,400,906 A | | 8/1983 | Bové | |
| 4,403,733 A | | 9/1983 | Bach et al. | |

(List continued on next page.)

FOREIGN PATENT DOCUMENTS

WO WO 02/102486 A1 12/2002

*Primary Examiner*—Jacob K. Ackun
*Assistant Examiner*—Bena B. Miller
(74) *Attorney, Agent, or Firm*—Akin Gump Strauss Hauer & Feld LLP

(57) ABSTRACT

A toy building construction set includes a plurality of building units, each building unit including an integral panel, an elongate column, and a connection member. The panel has a first and a second connection structure. One of four sides of the elongate column is a generally U-shaped channel. The column channel receives and is engaged with the second connection structure. The other three sides of the elongate column each have female connection structures so as to provide a female connection side to the building unit. The connection member is engaged with the first connection structure. At least part of the connection member projects outwardly from the panel so as to provide a male connection side to the building unit The male connection side is configured to removably engage with the female connection side of a second building unit of the plurality of building units.

51 Claims, 11 Drawing Sheets

U.S. PATENT DOCUMENTS

| | | | | |
|---|---|---|---|---|
| 4,508,519 | A | | 4/1985 | Becker |
| 4,523,418 | A | | 6/1985 | McLaughlin |
| 4,569,664 | A | | 2/1986 | Giampetruzzi et al. |
| 4,650,437 | A | | 3/1987 | Sitkus |
| 4,704,313 | A | * | 11/1987 | Maier ..... 428/33 |
| 4,932,916 | A | | 6/1990 | Blickle |
| 5,121,710 | A | | 6/1992 | Gonzalez |
| 5,445,552 | A | | 8/1995 | Hine |
| 5,482,490 | A | | 1/1996 | Weldon-Ming |
| 5,487,690 | A | | 1/1996 | Stoffle et al. |
| 5,575,701 | A | | 11/1996 | Hantman |
| 5,746,271 | A | | 5/1998 | DeCosta |
| 5,868,574 | A | | 2/1999 | Randle |
| 5,876,261 | A | | 3/1999 | Bach et al. |
| 5,975,977 | A | | 11/1999 | Choi |
| 6,073,404 | A | | 6/2000 | Norfleet |
| 6,261,147 | B1 | | 7/2001 | Bach et al. |
| 6,283,818 | B1 | | 9/2001 | Kushner et al. |
| 2002/0193046 | A1 | | 12/2002 | Zebersky |

* cited by examiner

TOY BUILDING CONSTRUCTION SET

CROSS-REFERENCE TO RELATED APPLICATIONS

This patent application claims priority to U.S. patent application No. 60/399,651, filed Jul. 29, 2002, entitled "Toy Building Construction Set," the subject matter of which is incorporated herein by reference.

BACKGROUND OF THE INVENTION

This invention generally relates to a toy building construction set.

Toy building construction sets are generally known. Such sets usually have a plurality of standard elements or building blocks with connection means that can be used together to form toy buildings and various other toy structures. Although easy to produce for the manufacturer, such sets generally require a certain amount of skill and dexterity to construct a structure. This level of skill, although present in many older children, is not usually present in younger children. Therefore, it is desirable for a toy building construction set to be comprised of a plurality of larger building units that are easier to use to construct a structure. Such a construction set would be easier for young children to learn how to use. Although such a construction set would require a little adult supervision in the beginning, within a relatively short time, it would be possible for even young children to construct a toy building without any adult assistance. Using the toy building set of the present invention, even a small child could construct a building for use with action figures and/or toy vehicles. Such a toy building could then be disassembled and reassembled in a different configuration as the child desires. In this way, the toy building set, although easy to use, is versatile enough to keep a child's interest for a long period of time.

BRIEF SUMMARY OF THE INVENTION

Briefly stated, in one aspect, the present invention is a toy building construction set including a plurality of building units. Each building unit includes an integral panel, an elongate column, and a connection member. The integral panel has opposing outer and inner major sides connected by a first lateral side, an opposing second lateral side, a top, and an opposing bottom. The first lateral side has a first connection structure and the second lateral side has a second connection structure. The elongate column has four elongate sides. One elongate side is open such that the other three elongate sides form a generally U-shaped channel of the column accessible along the one open side. The column channel receives and is engaged with the second connection structure of the panel. At least one of the other three elongate sides of the elongate column has at least one female connection structure to provide a female connection side to the building unit. The connection member has a first male side and a second male side. The first male side is engaged with the first connection structure of the panel and at least part of the second male side projects outwardly from the panel to define at least one male connection structure and provide a male connection side to the building unit. The male connection structure is configured to releasably engage with any of the female connection structures of the female connection side of a second building unit, thereby allowing interconnection of building units to construct a toy building.

In another aspect, the present invention is a toy building construction set including a plurality of building units. Each building unit includes an integral panel. The integral panel has opposing outer and inner major sides connected by a first lateral side, an opposing second lateral side, a top, and an opposing bottom. The first lateral side has a first connection structure. The second lateral side has a second connection structure. The first connection structure includes three pairs of second protrusions generally equally spaced from each other along a length of the first connection structure. Each second protrusion is semicircular when viewed from a distal end. Each pair of second protrusions collectively is generally circular when viewed together from the distal end. At least one pair of the second protrusions has a barb on each second protrusion of the pair. The second connection structure includes three generally equally spaced second apertures along at least one of three sides of the second connection structure to enable engagement with the three pairs of second protrusions in the at least one of three sides of the second connection structure. Each pair of second protrusions of a first building unit fits within the coinciding second aperture of a second building unit through one of the sides of the second connection structure. The barb extends through the corresponding second aperture and engages an inner side of the second connection structure when the second connection structure is in facing engagement with and abuts one of the sides of the first connection structure, enabling locking engagement of the pair of second protrusions within the coinciding second aperture and the locking engagement of the first building unit with the second building unit.

In another aspect, the present invention is a toy building construction set including a plurality of building units. Each building unit includes an integral panel and a connection member. The integral panel has opposing outer and inner major sides connected by a first lateral side, an opposing second lateral side, a top, and an opposing bottom. The first lateral side has a first connection structure. The second lateral side has a second connection structure. The connection member has a first male side and a second male side. The first male side is engaged with the first connection structure of the panel and at least part of the second male side projects outwardly from the panel to provide a male connection side to the building unit. The male connection side is configured to releasably engage with a female connection side of another building unit. The male connection side is configured to releasably engage with any of three female connection sides of other building units, thereby allowing the interconnection of the building units. The second male side include three pairs of second protrusions generally equally spaced from each other along a length of the male connection side. Each second protrusion is generally semicircular when viewed from a distal end. Each pair of second protrusions collectively is generally circular when viewed together from the distal end. At least one pair of second protrusions has a barb on each second protrusion of the pair. The second connection structure has three generally equally spaced second apertures along at least one of three sides of the second connection structure to enable engagement with the three pairs of second protrusions. Each pair of second protrusions of the connection member of a first building unit fits within the coinciding second aperture of a second connection structure of a second building unit through one of the sides of the second connection structure. The barbs of the second protrusion pair extend through the corresponding second aperture and engage an inner side of the second connection structure when the second connection structure is in facing engagement with and abuts one of the sides of the connection member, enabling locking engagement of the pair of second protrusions within the coinciding second aperture and the locking engagement of the first building unit with the second building unit In another aspect, the present invention is a toy building construction set including a plurality of building units. Each building unit includes an integral panel and an elongate column. The integral panel has opposing outer and inner major sides connected by a first lateral side, an opposing second lateral side, a top, and an opposing bottom. The first lateral side has a first connection structure. The second lateral side has a second connection structure. The elongate column has four elongate sides. One elongate side is open such that the other three elongate sides form a generally U-shaped channel of the column accessible along the one open side. The column channel receives and is engaged with the second connection structure of the panel. The other three elongate sides of the elongate column each have female connection structures to provide a female connection side to the building unit. The first connection structure includes three pairs of second protrusions generally equally spaced from each other along a length of the first connection structure. Each second protrusion is semicircular when viewed from a distal end. Each pair of second protrusions collectively is generally circular when viewed together from the distal end. At least one pair of the second protrusions has a barb on each second protrusion of the pair. The elongate column includes three equally spaced second apertures along each of three sides of the elongate column to enable engagement with the three pairs of second protrusions in any of the three sides of the second connection structure. Each pair of second protrusions of the first connection structure of a first building unit fits within the coinciding second aperture of a second building unit through one of the sides of the elongate column. The barb extends through the corresponding second aperture and engages an inner side of the elongate column when the first connection structure is in facing engagement with and abuts one of the sides of the elongate column, enabling locking engagement of the pair of second protrusions within the coinciding second aperture and the locking engagement of the first building unit with the second building unit.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
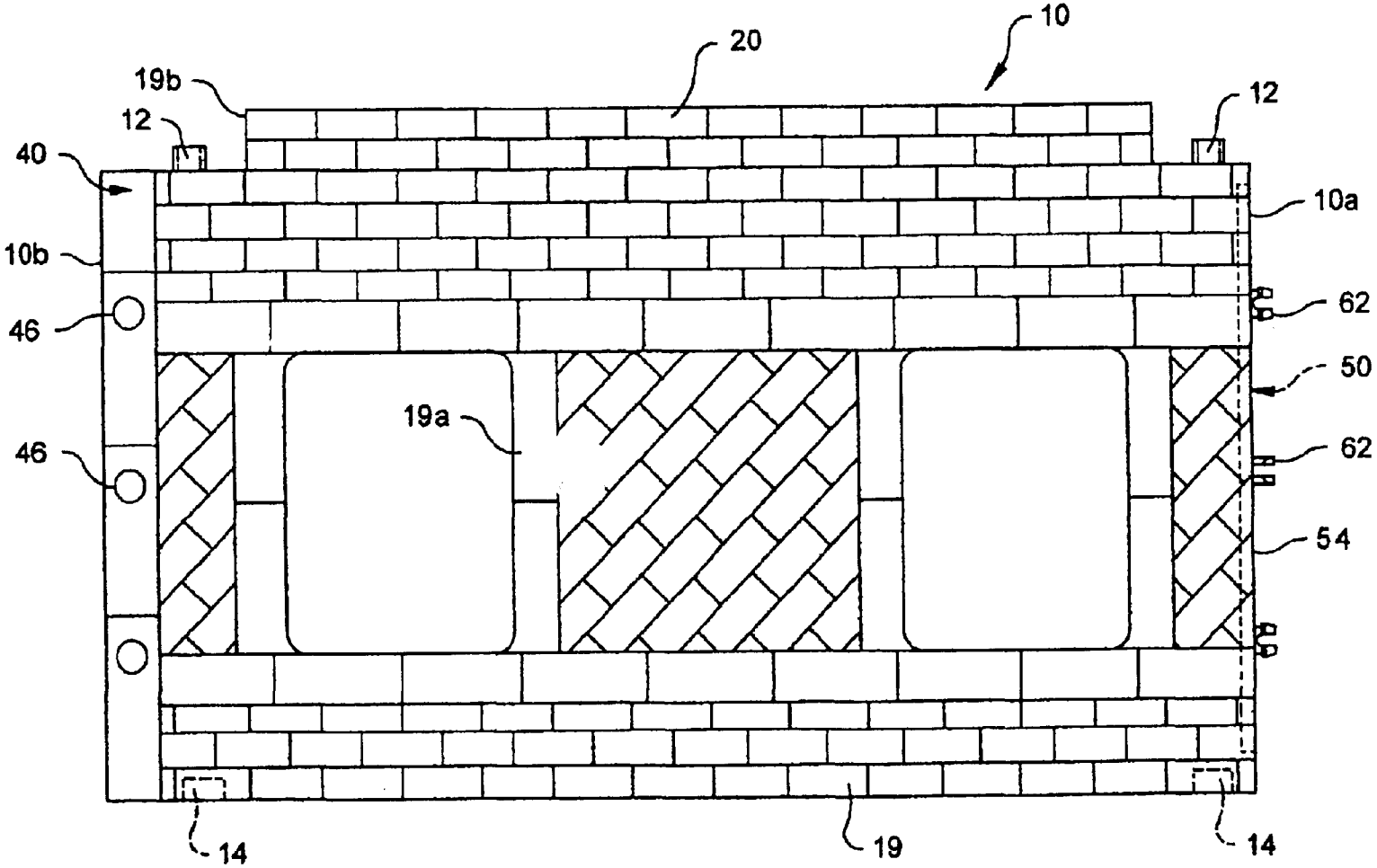
FIG. 1 is a front elevational view of a building unit in accordance with a preferred embodiment of the present invention.
Figure 1A:
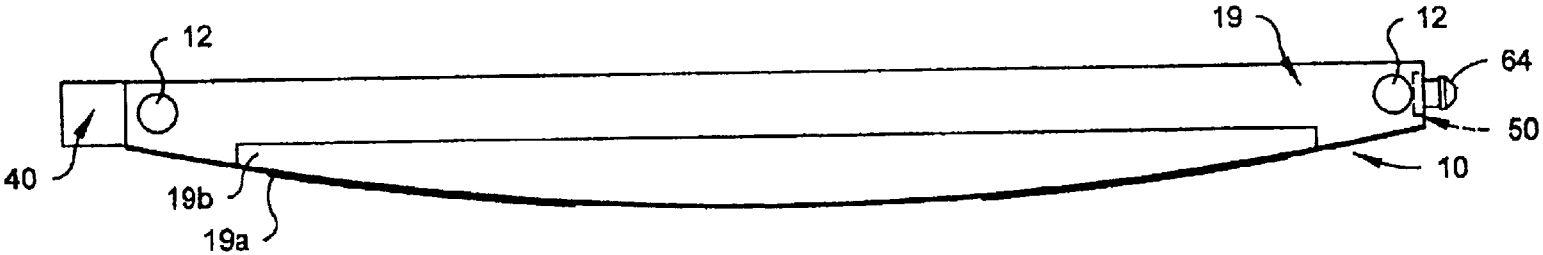
FIG. 1*a* is a top plan view of the building unit of FIG. 1.

Certain terminology is used in the following description for convenience only and is not limiting. The words "right", "left", "upper", and "lower", designate directions in the drawings to which reference is made. The terminology includes the words above specifically mentioned, derivatives thereof, and words of similar import.

Referring to the drawings in detail, wherein in like numerals indicate like elements throughout, there is shown in FIGS. 1–13 elements of a preferred embodiment of a toy building construction set in accordance with the present invention. The toy building construction set includes a plurality of building units, indicated generally at 10. Referring to FIG. 1, a preferred embodiment of one building unit 10 of the present invention is shown. The building unit 10, fully assembled, comprises an integral panel indicated generically at 19, an elongate column 40, and a connection member 50.

Figure 4:
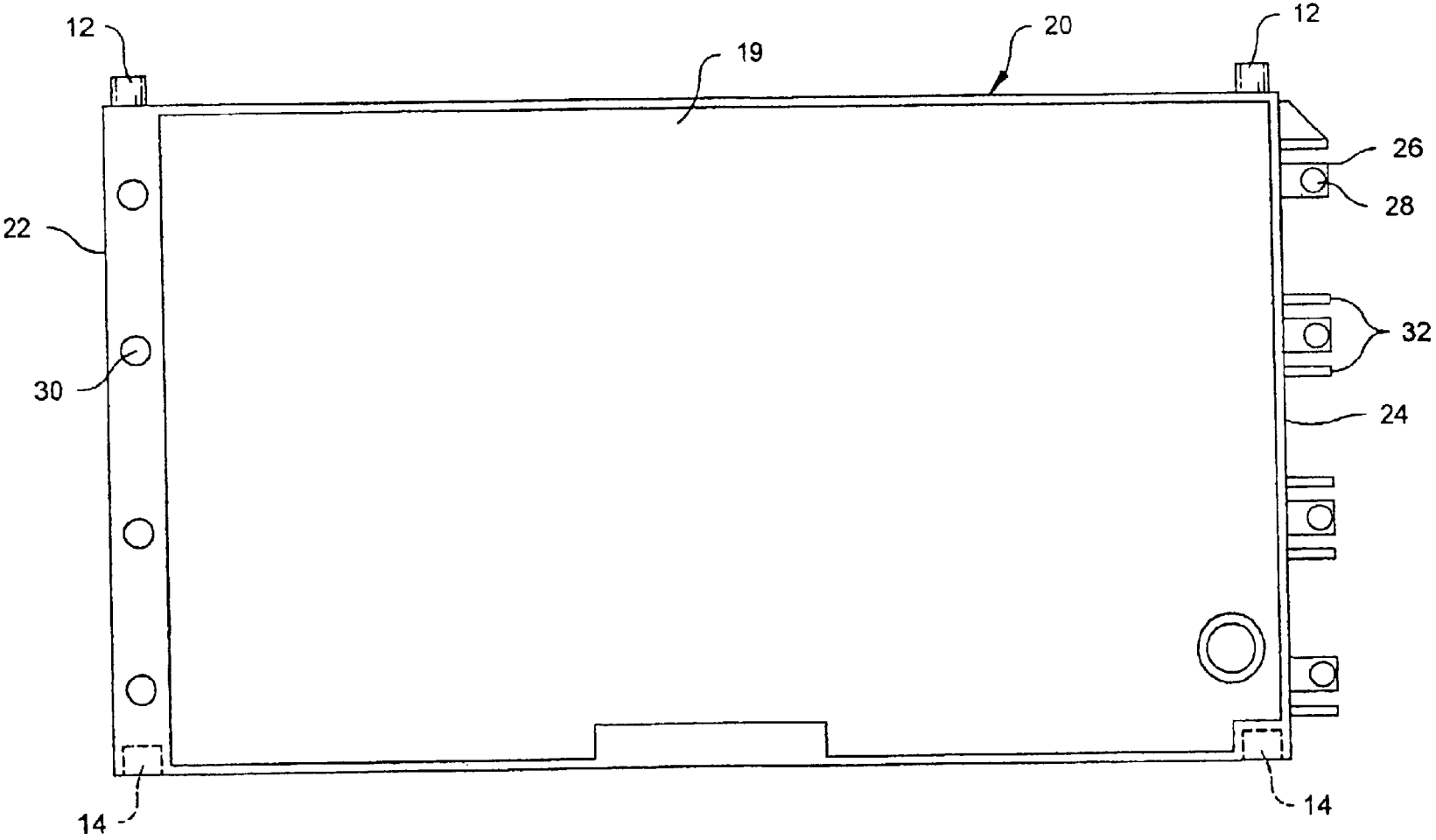
FIG. 4 is an elevational view of the inner major side of the double-width panel in accordance with a preferred embodiment of the present invention.
Figure 5:
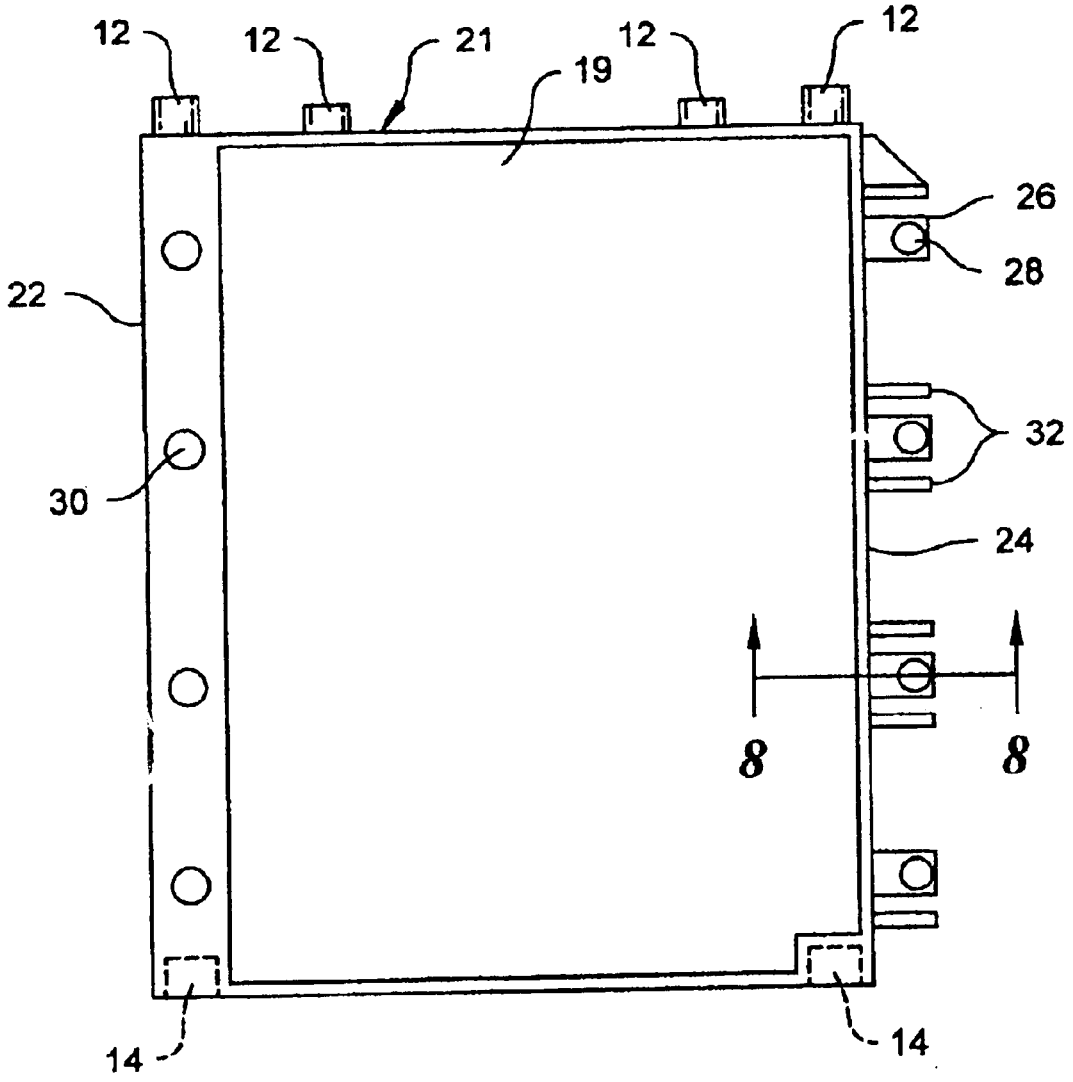
FIG. 5 is an elevational view of the inner major side of a single-width panel in accordance with a preferred embodiment of the present invention.

Referring now to FIGS. 4–8, the integral panel 19 can be either a double-width panel 20 (FIG. 4) or a single-width panel 21 (FIGS. 5). The outer major side of the integral panel 19 is intended to simulate the side of a building, preferably having a texture to simulate a brick face or other wall covering. The integral panel 19 can include windows 19*a*, doorways, lamp mounts, and hose connections and other building fixtures and architectural elements, for example, a parapet 19*b*. The integral panel 19 has opposing outer and inner major sides connected by a first lateral side, an opposing second lateral side, a top, and an opposing bottom, the latter two extending between the lateral sides.

Figure 6:
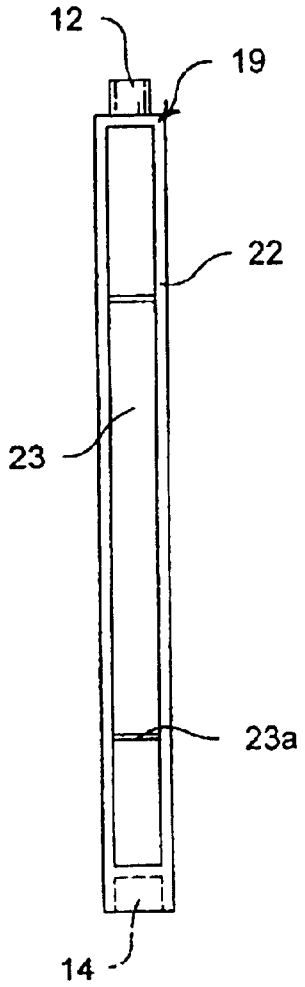
FIG. 6 is a left side elevational view of the first connection structure of the first lateral side of the panel of FIG. 4 or FIG. 5.

The first lateral side has a first connection structure 22. Referring specifically to FIGS. 4, 5, and 6, the first connection structure 22 is an elongate channel 23 within the first lateral side of the panel 19 running approximately from the top of the panel 19 to approximately the bottom of the panel 19. The panel channel 23 has a plurality of support members 23*a*, which are within and span across the width of the panel channel 23 (i.e. the thickness of the pantle defining the first lateral side) to help prevent distortion of the sides of the panel channel 23 either inwardly or outwardly. Significant distortion in either direction could lead to difficulties in assembling the building unit 10. The first connection structure also includes at least one and preferably a plurality of circular first apertures 30 through one side of the panel channel 23. Although the present invention is depicted with four of the first apertures 30, it is within the spirit and scope of the present invention to contemplate any number of the first apertures 30. The first apertures 30 are preferably through the side of the panel channel 23 corresponding to the inner major side of the integral panel 19.

Figure 7:
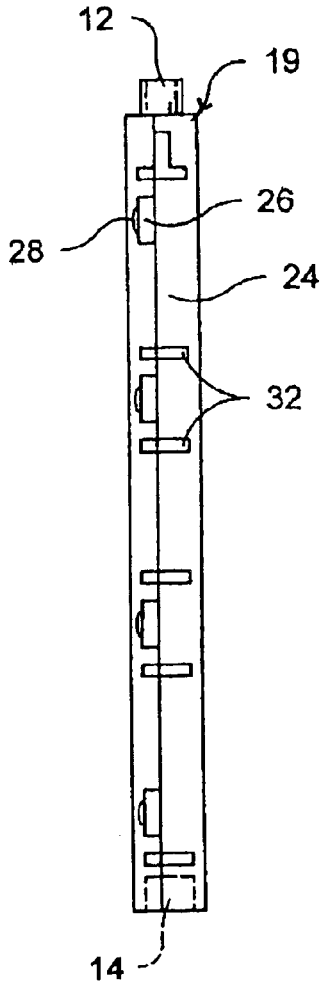
FIG. 7 is a right side elevational view of the second connection structure of the second lateral side of the panel of FIG. 4 or FIG. 5.
Figure 8:
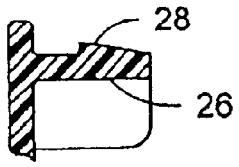
FIG. 8 is a cross-sectional view of one of the third protrusions of FIG. 5, taken along line 8—8.

The second lateral side of the panel 19 has a second connection structure 24. Referring specifically to FIGS. 4, 5, 7, and 8, the second connection structure 24 of the panel 19 includes at least one and preferably a plurality of third tabs 26 extending outwardly therefrom. Although the present invention is depicted with four of the third tabs 26, it is within the spirit and scope of the present invention to contemplate any number of the third tabs 26. The third tabs 26 are generally oriented along lines extending across the second lateral side of the panel 19 from the top to the bottom. Each third tab 26 has a third protrusion 28 extending outwardly therefrom. It is preferable that the third protrusions 28 are generally cylindrical with distal ends that are sloped such that the third protrusions 28 increase in height from a side of the third protrusion 28 farthest from the second lateral side of the panel 19 to the side of the third protrusion 28 closest to the second lateral side of the panel 19 (see FIG. 8). The second connection structure 24 further includes at least one and preferably a plurality of fourth tabs 32 extending therefrom. The fourth tabs 32 are generally rectangular in shape and are oriented generally perpendicularly to the third tabs 26, such that the fourth tabs 32 are oriented along lines extending across the second lateral side of the panel 19 between the inner major side and the outer major side. Although the present invention is depicted with six of the fourth tabs 32, it is within the spirit and scope of the present invention to contemplate any number of the fourth tabs 32. The central vertical line in FIG. 7 is a mold line and has no relation to the claimed invention.

Referring to FIGS. 4–7, each integral panel 19 has a plurality of cylindrical fourth protrusions 12 along the top. Preferably, the double-width panel 20 has two of the fourth protrusions 12 located at the top of the double-width panel 20 with one of the fourth protrusions 12 proximate each of the first and second lateral sides. Preferably, the single-width panel 21 has four of the fourth protrusions 12 located at the top of the single-width panel 21 with one of the fourth protrusions 12 proximate each of the first and second lateral sides and the remaining two of the fourth protrusions 12 symmetrically located therebetween. The integral panel 19 has a plurality of second openings 14 located within the bottom of the integral panel 19. Preferably, there are two of the second openings 14, preferably each hexagonal in shape, with one of the second opening 14 located proximate each of the first and second lateral sides of the integral panel 19. It is within the spirit and scope of the present invention that the integral panel 19 can have any number of the fourth protrusions 12 and the second openings 14 in any shape so long as they can mate with one another, and, consequently, the numbers and shapes of the fourth protrusions 12 and second openings 14 described above are not limiting.

Figure 9:
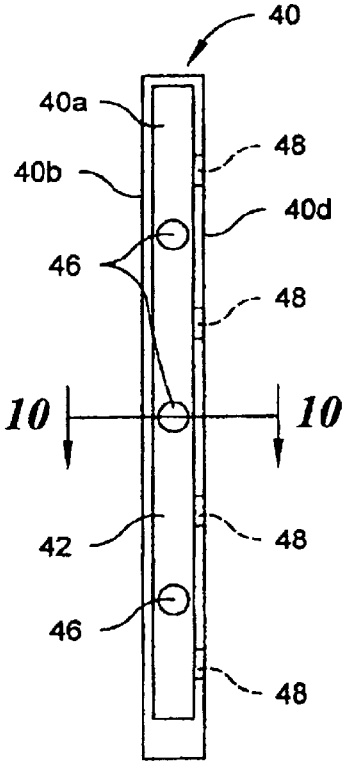
FIG. 9 is an elevational view of the channel side of an elongate column in accordance with a preferred embodiment of the present invention.
Figure 10:
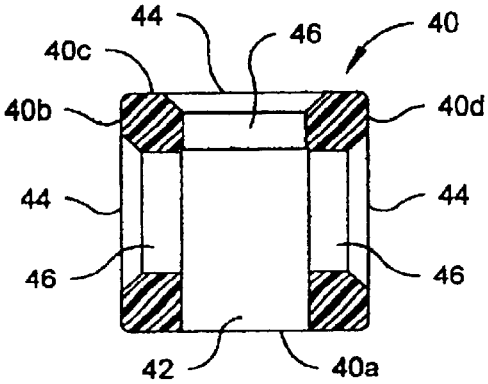
FIG. 10 is a cross-sectional view of the elongate column of FIG. 9, taken along line 10—10.

Referring to FIGS. 9–10, there is shown the elongate column 40 which has a top, a bottom, and four elongate sides 40*a*, 40*b*, 40*c*, 40*d*. One elongate side 40*a* is open such that the other three elongate sides 40*b*, 40*c*, 40*d* form a generally U-shaped column channel 42 accessible along the one open side 40*a* The column channel 42 extends along the one side 40*a* from proximate the top of the elongate column 40 to proximate the bottom. At least one of the other three sides 40*b*, 40*c*, 40*d* has at least one and preferably a plurality of circular second apertures 46. Each side 40*b*, 40*c*, and 40*d* having at least one second aperture 46 forms a female connection structure 44. Preferably, the female connection structure 44 of each of the other three sides 40*b*, 40*c*, 40*d* has three roughly equally spaced second apertures 46, although it is within the spirit and scope of the present invention that each of the female connection structures 44 has any number of second apertures 46. One of the other three sides 40*d* has a plurality of circular third apertures 48 therethrough. It is preferable that there are four of the third apertures 48 spaced along the side 40*d* interspersed among the three provided second apertures 46 (see FIG. 9). It is further preferred that the center-to-center spacing between any adjacent pair of the second apertures 46 is approximately three centimeters. The apertures 46 are preferably conical and taper from a diameter of about seven millimeters to between five and six millimeters.

Figure 11:
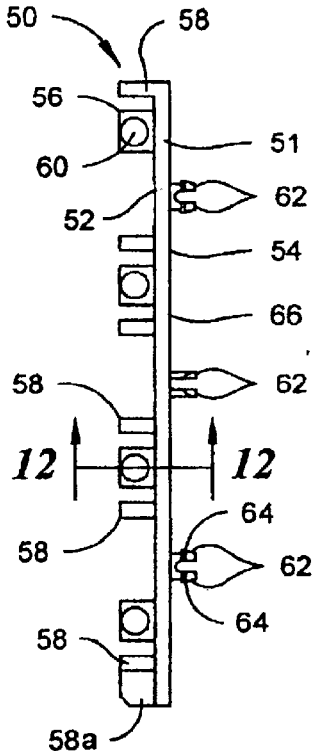
FIG. 11 is an elevational view of the connection member in accordance with a preferred embodiment of the present invention.
Figure 12:
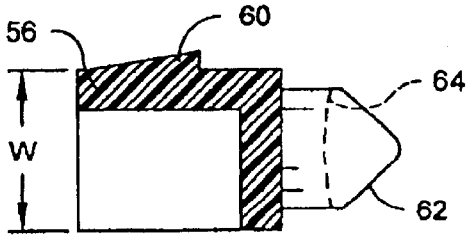
FIG. 12 is a cross-sectional view of one of the first protrusions of FIG. 11, taken along line 12—12.

Referring to FIGS. 11 and 12, there is shown the connection member 50. The connection member 50 includes a main body 51 that is essentially a flat element having a width W measured from one side to the other side (FIG. 12). The flat main body element 51 of the connection member 50 has a first male side 52 forming one major side and a second male side 54 forming the other, opposing major side. The first male side 52 of the connection member SO includes at least one and preferably a plurality of spaced apart rectangular first tabs 56 extending outwardly therefrom. The first tabs 56 are generally parallel to each other and the plane of FIG. 11 and oriented along one lateral straight edge of the first male side 52 of the connection member 50 between its longitudinal ends. Preferably, there are four of the first tabs 56 spaced along the first male side 52, although it is within the spirit and scope of the present invention that there be any number of first tabs 56. The first tabs 56 are proximate one longitudinal side edge of the flat main body element 51. Referring specifically to FIG. 12, the first tabs 56 each have a first protrusion 60 extending outwardly therefrom such that the first protrusions 60 extend slightly beyond the width W of the flat main body 51 of the connection member 50, the width being measured across the main body 51 (see FIG. 12). It is preferable that the first protrusions 60 are generally cylindrical and main bodies have a distal surface sloped such that the first protrusions 60 increase in height from a side of the first protrusion 60 farthest from the main body 51 and second male side 54 of the connection member 50 to the side of the first protrusion 60 closest to the main body 51 and second male side 54 of the connection member 50. Referring again to FIGS. 11 and 12, the first male side 52 of the connection member 50 further includes at least one and preferably a plurality of second tabs 58 extending therefrom.

The second tabs 58 are generally perpendicular to the vertically extending first tabs 56 and extend across the width W of the flat main body 51 of the connection member 50. Although the present invention is depicted with six of the second tabs 58, it is within the spirit and scope of the present invention to contemplate any number of second tabs 58. The second tabs 58 are sized to fit closely into the elongate channel 23 where inner pairs flank the two innermost first protrusions 60 for stability. Proferably, the shape and features of the first male side 52 of the connection member 50 is similar to those of the second connection structure 24 of the integral panel 19.

The second male side 54 of the connection member 50 includes at least one and preferably a plurality of second protrusions 62 spaced along a length of the connection member 50. Each second protrusion 62 is paired with and spaced from another second protrusion 62. Preferably, there are three pairs of second protrusions 62 generally equally spaced along the second male side 54, although it is within the spirit and scope the present invention for there to be any number of pairs of second protrusions 62. Each second protrusion 62 is semicircular when viewed from a distal end. Each pair of second protrusion 62 collectively is generally circular when viewed together from the distal ends of the protrusions. At least one pair and preferably at least each outermost pair of second protrusions 62 has a barb 64 on each second protrusion 62 of the pair. The center pair may not, as depicted in FIG. 12. The location of the barb 64, if it were provided on the center pair, is indicated in phantom in FIG. 12.

Referring again to FIG. 1, the fully assembled building unit 10 includes the elongate column 40 and the connection member 50, both engaged with the integral panel 19. The column channel 42 receives and is engaged with the second connection structure 24 of the integral panel 19. The third protrusions 28 are positioned to engage with mating third apertures 48 along one side 40*d* of the elongate column 40. The circular third protrusions 28 are configured to provide a locking engagement of the second connection structure 24 within the column channel 42. The fourth tabs 32 substantially encompass a width of the column channel 42 when the second connection structure 24 is engaged with the column channel 42 such that the second connection structure 24 is essentially immobile in the elongate column 40, thereby creating an interference fit.

The panel channel 23 of the first connection structure 22 of the integral panel 19 receives and is engaged with the first male side 52 of the connection member 50 in essentially the same way as the engagement of the column channel 42 with the second connection structure 24 described above. The first male side 52 of the connection member 50 is configured to be accepted by and engaged within the panel channel 23 of the first connection structure 22. The plurality of first tabs 56 each have first protrusions 60 configured to engage with a like plurality of mating first apertures 30 along one side of the panel channel 23 so as to lock the connection member 50 within the panel channel 23. The second tabs 58 substantially encompass a width and depth of the panel channel 23 to closely fit within the channel 23 whereby the connection member 50 is engaged with the panel channel 23 such that the connection member 50 is essentially immobile in the panel 19, thereby creating an interference fit. In this way, the first male side 52 engages with the first connection structure 22 of the integral panel 19 such that at least part of the second male side 54 projects outwardly from the panel 19 to define at least one male connection structure 66 and provide a male connection side 10*a* to the building unit 10. It is preferred that the first male side 52 engages with the first connection structure 22 in such a way that it is not easily disengaged or not disengaged without tools so as to prevent a user from accidentally separating the building units 10 at an improper location or in an undesired way.

Figure 2:
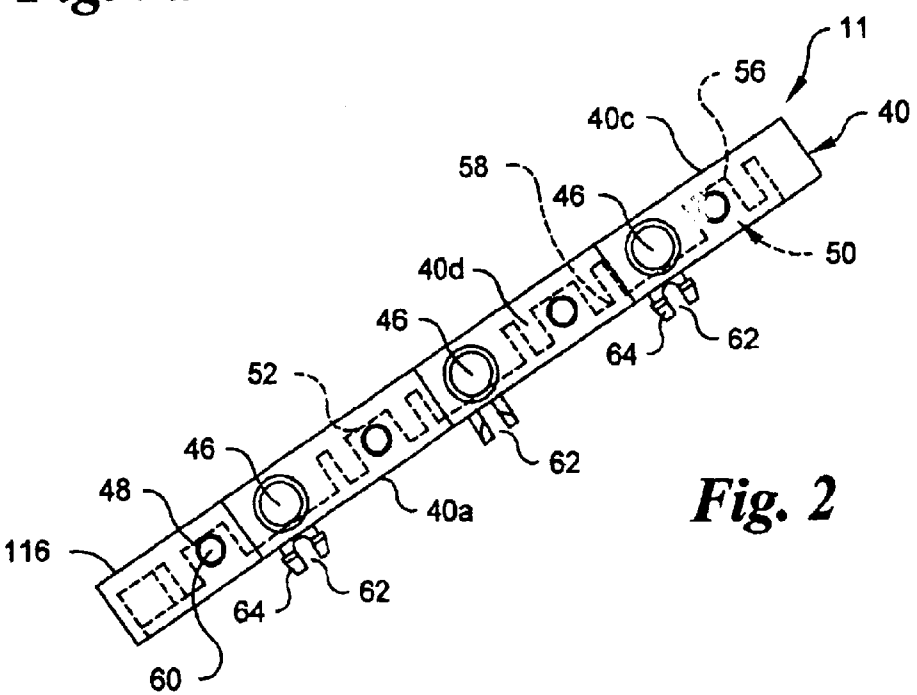
FIG. 2 is a front elevational view of an intermediate building unit in accordance with a preferred embodiment of the present invention.

Referring to FIG. 2, the elongate column 40 can also be engaged with the first male side 52 of the connection member 50 to form an intermediate building unit 11. The column channel 42 of the elongate column 40 engages with the first male side 52 of the connection member 50 in much the same way as described above with respect to the engagement of the connection member 50 with the integral panel 19. The first male side 52 of the connection member 50 is configured to be accepted by and engaged within the column channel 42. The first protrusions 60 of the first tabs 56 are configured to engage with the like plurality of mating third apertures 48 along one side 40*d* of the elongate column 40 (seen in FIG. 2) so as to lock the connection member 50 within the column channel 42. The second tabs 58 substantially encompass a width and depth of the column channel 42 whereby the connection member 50 is engaged with and closely fixed into the column channel 42 such that the connection member 50 is essentially immobile in the elongate column 40, thereby creating an interference fit. In this way, the first male side 52 engages with the column channel 42. It is preferred that the first male side 52 engages with the elongate column 40 in such a way that it is not easily disengaged so as to prevent a user from accidentally separating the intermediate building units 11 at an improper location.

Figure 3B:
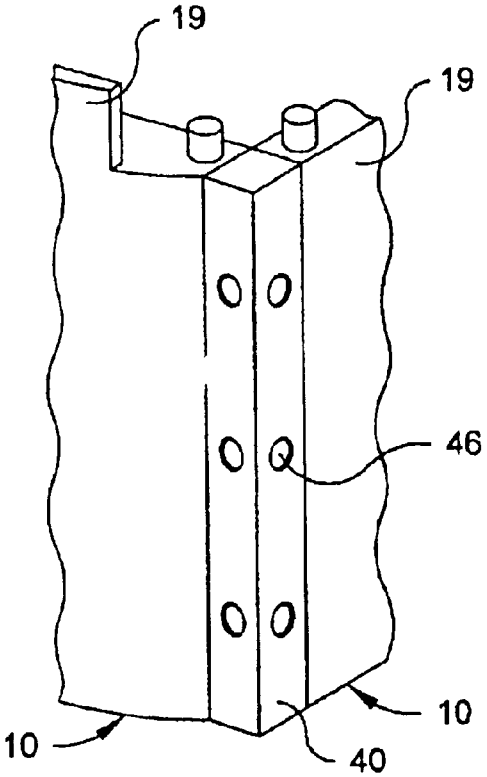
FIG. 3B is an elevational view of the two building units of FIG. 3A connected in accordance with a preferred embodiment of the present invention.
Figure 3A:
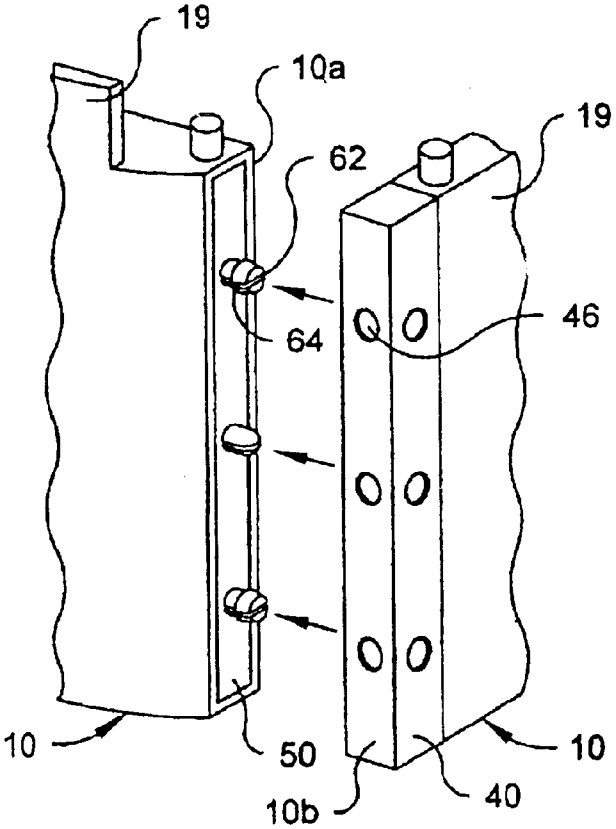
FIG. 3A is an elevational view of two building units of FIG. 1 poised for connection in accordance with a preferred embodiment of the present invention.

Referring to FIGS. 1 and 2, when assembled, each building unit 10 has a female connection side 10*b*, and each intermediate building unit 11 has a female connection side 11*b*. The female connection side 10*b*, 11*b* is made up of the female connection structures 44 of the three exposed sides 40*b*, 40*c*, 40*d* of the elongate column 40. At least part of the second male side 54 projects outwardly from the panel 19 so as to define the male connection structure 66 and provide the male connection side 10*a* to the building unit 10. At least part (i.e. projections 62) of the second male side 54 projects outwardly from the elongate column 40 so as to provide the male connection side 11*a* to the intermediate building unit 11. Referring now to FIGS. 3A and 3B, the male connection side 10*a* (and 11*a*) is configured to removably engage with either the female connection side 10*b* of a second building unit 10 of the plurality of building units 10 or the female connection side 11*b* of a second intermediate building unit 11. The female connection side 10*b*, 11*b* is configured to releasably engage with up to three male connection sides 10*a*, 11*a* of other building units 10 and intermediate building units 11. In this way, the interconnection of building units 10 and intermediate building units 11 is made possible to construct a toy building.

Actual engagement between building units 10 and/or intermediate building units 11 is accomplished in the following manner. Each pair of second protrusion 62 fits within a coinciding second aperture 46 through one of the sides of the column 40. The barb 64 of each of the second protrusion 62 extends through the second aperture 46 and engages an inner side of the elongate column 40 when the second male side 54 of the connection member 50 is in facing engagement with and abuts one of the sides of the elongate column 40. This enables the locking engagement of the pair of second protrusions 62 within the coinciding second aperture 46 and the locking engagement of the connection member 50 with the elongate column 40.

It is preferable to have at least the first building unit 10 and the second building unit 10 of the plurality of building units 10 of different widths. In order to do so, it is preferable to have integral building panels 19 of different widths between the first and second lateral sides of each integral panel 19. Specifically, it is preferable to have the first building unit panel 19, with the double-width panel 20, approximately twice as wide the second building unit panel 19, with the single-width panel 21. More particularly, the width of the double wide panel 20 is generally equal to twice the width of the single wide panel 21 plus the width of an elongate column 40 (not including the second protrusions 62). Suggestedly, the width of each smaller (second) integral building unit 10 is about ten centimeters and the width of each larger (first) integral building units 10 is about twenty-one centimeters. These widths are exemplary, and should not be considered to be limiting, except to be compatible with the units 10, 11 having these widths.

Figure 13:
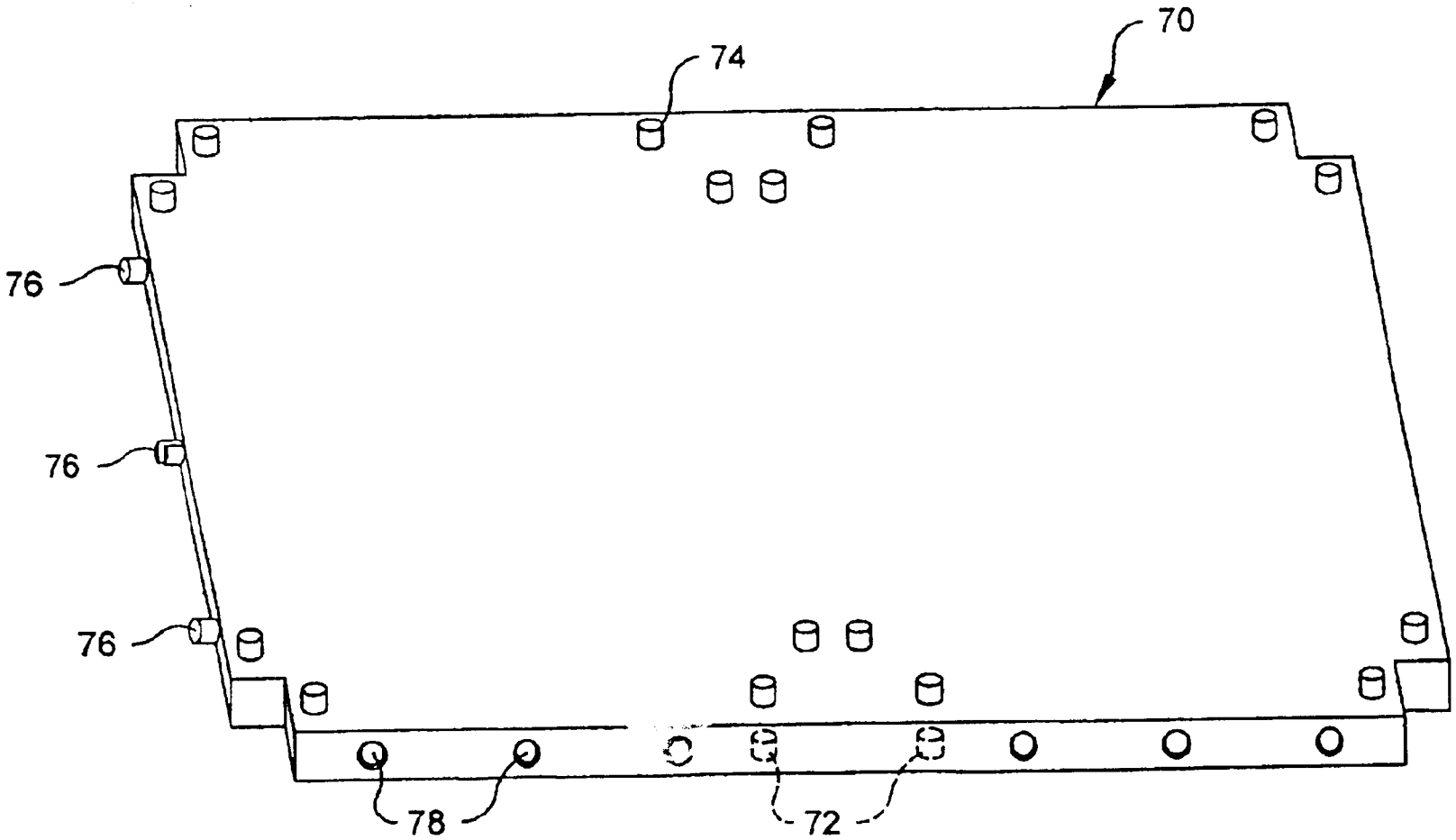
FIG. 13 is a top plan view of a horizontal panel in accordance with a preferred embodiment of the present invention.

Referring to FIG. 13, the toy building construction set preferably includes at least one horizontal panel 70 configured for attachment on and/or beneath the building units 10, 11. The horizontal panel 70 is preferably generally rectangular and is further preferably patterned to simulate bricks, tiles, or other surface coverings in order to simulate an actual floor (or roof). The horizontal panel 70 has a top, a bottom, and four edges. Top and bottom are major opposing sides. At least one of the edges and preferably each of two opposing edges has a plurality of sixth protrusions 76 extending outwardly therefrom. Preferably, three of the sixth protrusions 76 extend outwardly from each of the two opposing edges. It is preferable that at least one sixth protrusion 76 has barbs, similar to the second protrusions 62 of the connection member 50, as described above. The remaining sixth protrusions 76 are preferably cylindrical. The other opposing edges of the horizontal panel 70 have third openings 78, preferably adequately sized and spaced apart to receive coinciding sixth protrusions 76 of other horizontal panels 70.

The top of the horizontal panel 70 has a plurality of fifth protrusions 74 extending upwardly therefrom. Within the bottom of the horizontal panel 70 are a plurality of first openings 72. The preferred number of fifth protrusions 74 and first openings 72 varies depending upon the size of the horizontal panel 70. The horizontal panel 70 should be sized to accommodate building units 10 having either single-width panels 21 of double-width panels 20. Preferably, there are two sizes of horizontal panels 70: a single-width horizontal panel (not shown) and a double-width horizontal panel 70. The single-width horizontal panel has four edges of equal length such that the length of the edges corresponds with the length of the single-width panel 19. The double-width horizontal panel 70 has two opposing edges of a width corresponding to the double-width panel 20 and two opposing edges of a width corresponding to the single-width panel 19.

The horizontal panel is removably engageable with at least one of the top and bottom of the integral panel 19 of at least one of the plurality of building units 10 such that the at least one building unit 10 makes up at least a part of a wall of the toy building and the horizontal panels 70 makes up one of a floor and a ceiling of the toy building. The fourth protrusions 12 of the integral panel 19 are configured to removably engage with at least of some of the first openings 72 when the horizontal panel 70 is used as a ceiling of the toy building. The first openings 72 of the horizontal panel 70 are arranged so as to engage with the plurality of fourth protrusions 12 of the integral panel 19. The fifth protrusions 74 removeably engage within at least some of the second openings 14 of the integral panel 19 when the horizontal panel 70 is used as a floor of the toy building. The fifth protrusions 74 are arranged to coincide with the second openings 14 of the integral panel 19 of either width.

For each building unit 10 of the plurality of building units 10, the panel 19, the elongate column 40 and the connection member 50 are each molded from polymer materials preferably different from one another. In this way, each building unit 10 is preferably formed from three different polymer materials. Preferably, the panel 19 is made of styrene, the elongate column 40 is made of acrylonitrile-butadiene-styrene (ABS) resin, and the connection member 50 is made of nylon. By making the panel 19, elongate column 40, and connection member 50 of such materials, the connection functions are facilitated. The elongate column 40 and the integral panel 19 are made from tough, rigid materials while the connection member 50 is made of a tough but more flexible material. Using such materials facilitates engagement and disengagement of the connection member 50 with the elongate column 40. Separation and/or breaking at improper locations, such as between the integral panel 19 and the elongate column 40, is also less likely using such materials. Although the above listed materials are preferred, it is within the spirit and scope of the present invention that other materials may be used in the components that facilitate connections between building units 10. The above-listed materials, therefore, are not meant to be limiting.

Figure 14:
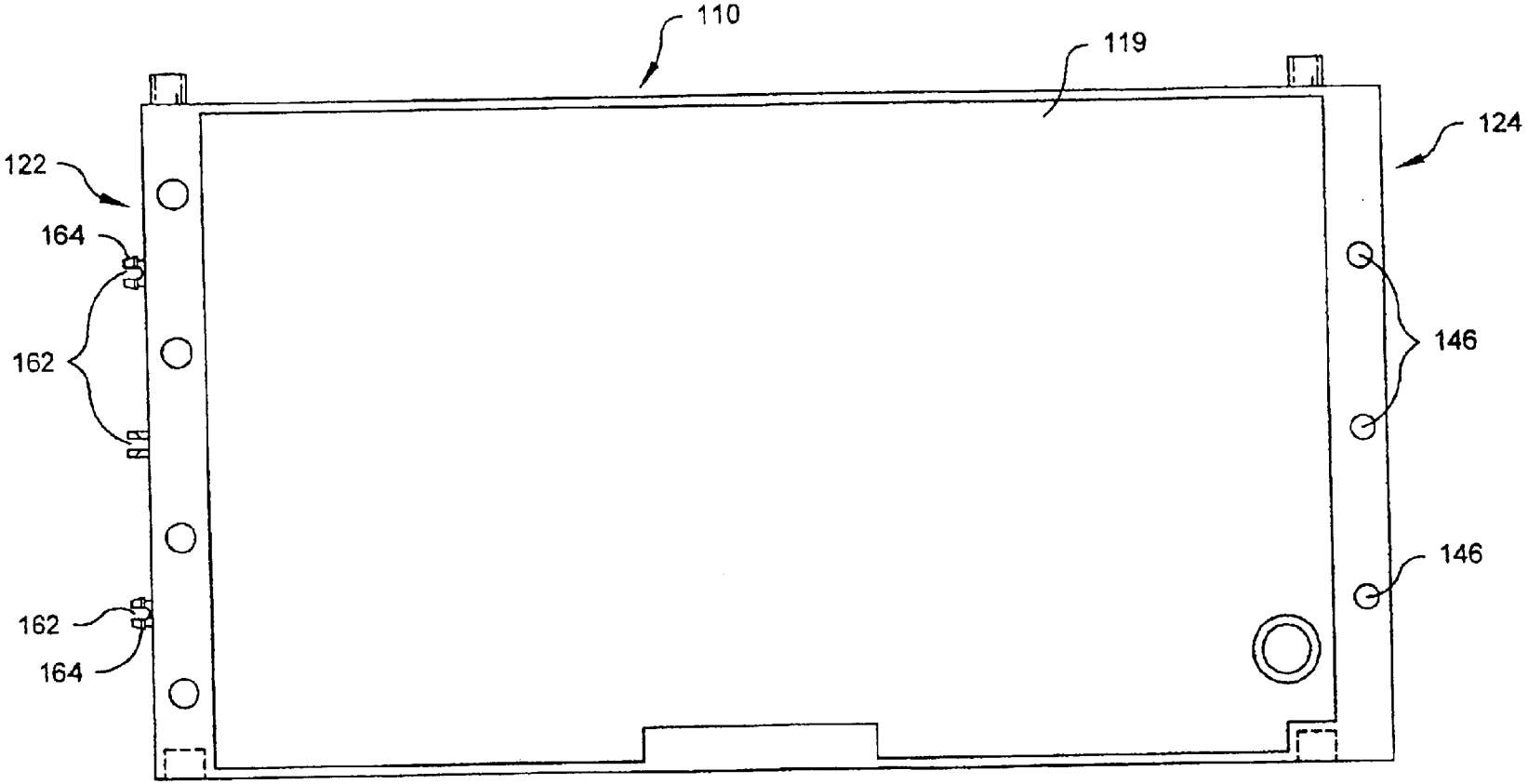
FIG. 14 is an elevational view of the inner major side of an integral panel in accordance with a first alternate embodiment of the present invention.

Referring to FIG. 14, a first alternate embodiment building unit 110 is shown which includes an integral panel 119. The integral panel 119 is essentially the integral panel 19, elongate column 40, and connection member 50 of the preferred embodiment molded together as a single piece. The integral panel 119 has opposing outer and inner major sides connected by a first lateral side, an opposing second lateral side, a top, and an opposing bottom. The first lateral side has a first (male) connection structure 122, and the second lateral side has a second (female) connection structure 124. The first connection structure 122 includes at least one and preferably three pairs of second protrusions 162 generally equally spaced from each other along a height of the first connection structure 122. Each second protrusion 162 is semicircular when viewed from a distal end. Each pair of second protrusions 162 collectively is generally circular when viewed together from the distal end. Preferably, at least one pair of the second protrusions 162 has a barb 164 on each second protrusion 162 of the pair. The second (female) connection structure 124 includes three generally equally spaced second apertures 146 along at least one and preferably all three sides of the second connection structure to enable engagement with corresponding pairs of second protrusions 162. Each pair of the second protrusions 162 of a first building unit 110 fits within the coinciding second aperture 146 of a second building unit 110 through one of the sides of the second connection structure 124. The barb 164 extends through the corresponding second aperture 146 and engages an inner side of the second connection structure 124 when the second connection structure 124 is in facing engagement with and abuts one of the sides of the first connection structure 122, enabling locking engagement of the pair of second protrusions 162 within the coinciding second aperture 146 and the locking engagement of the first building unit 110 with the second building unit 110. Again, the center-to-center spacing between any two adjacent second apertures 146 is approximately three centimeters and the diameter of each second aperture 146 tapers down to between five and six millimeters, preferably about 5.5 millimeters.

Figure 15:
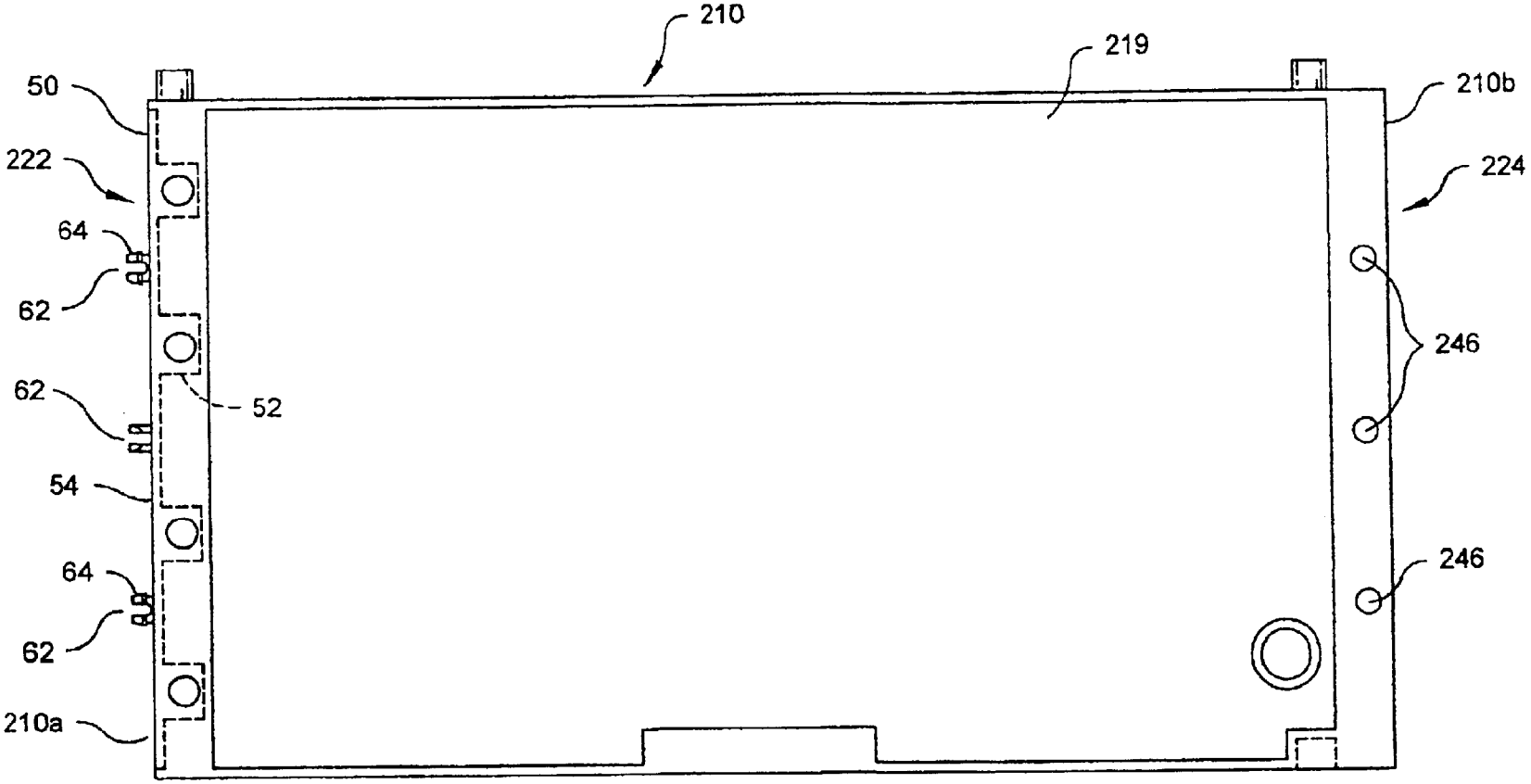
FIG. 15 is an elevational view of the inner major side of an integral panel in accordance with a second alternate embodiment of the present invention.

Referring to FIG. 15, a second alternate embodiment building unit 210 is shown which includes an integral panel 219 and the connection member 50 (FIGS. 11 and 12). The integral panel 219 is essentially the integral panel 19 and elongate column 40 of the preferred embodiments molded together as a single piece. The integral panel 219 has opposing outer and inner major sides connected by a first lateral side, an opposing second lateral side, a top, and an opposing bottom, the first lateral side having a first connection structure 222 in the form of a channel like channel 23 of FIG. 6, and the second lateral side having a second connection structure 224 like the female structure of column 40. The first male side 52 of connection member 50 is engaged with the first connection structure 222 of the panel 219, and at least part of the second male side 54 projects outwardly from the panel 219 to provide a male connection side to the building unit 210. The male connection side is configured to releasably engage with a female connection side of another building unit 210 (and any other unit 10, 11, 110). The male connection side is configured to releasably engage with any of three female connection sides of other building units 210 (and any other unit 10, 11, 110), thereby allowing the interconnection of the building units 210. The second male side 54 preferably includes three pairs of second protrusions 62 generally equally spaced from each other along the male connection side. Each second protrusion 62 is generally semicircular when viewed from a distal end. Each pair of second protrusions 62 collectively is generally circular when viewed together from the distal end. At least one pair of second protrusions 62 has a barb 64 on each second protrusion 62 of the pair. The second connection structure 224 preferably has three generally equally spaced second apertures 246 along at least one and preferably all three sides of the second connection structure 224 to enable engagement with the three pairs of second protrusions 62. Engagement is the same as it is between units 10, 110. Again, the center-to-center spacing between any two adjacent second apertures 246 preferably is approximately three centimeters and the diameter of each second aperture 246 tapers down to between five and six millimeters preferably about 5.5 millimeters.

Figure 16:
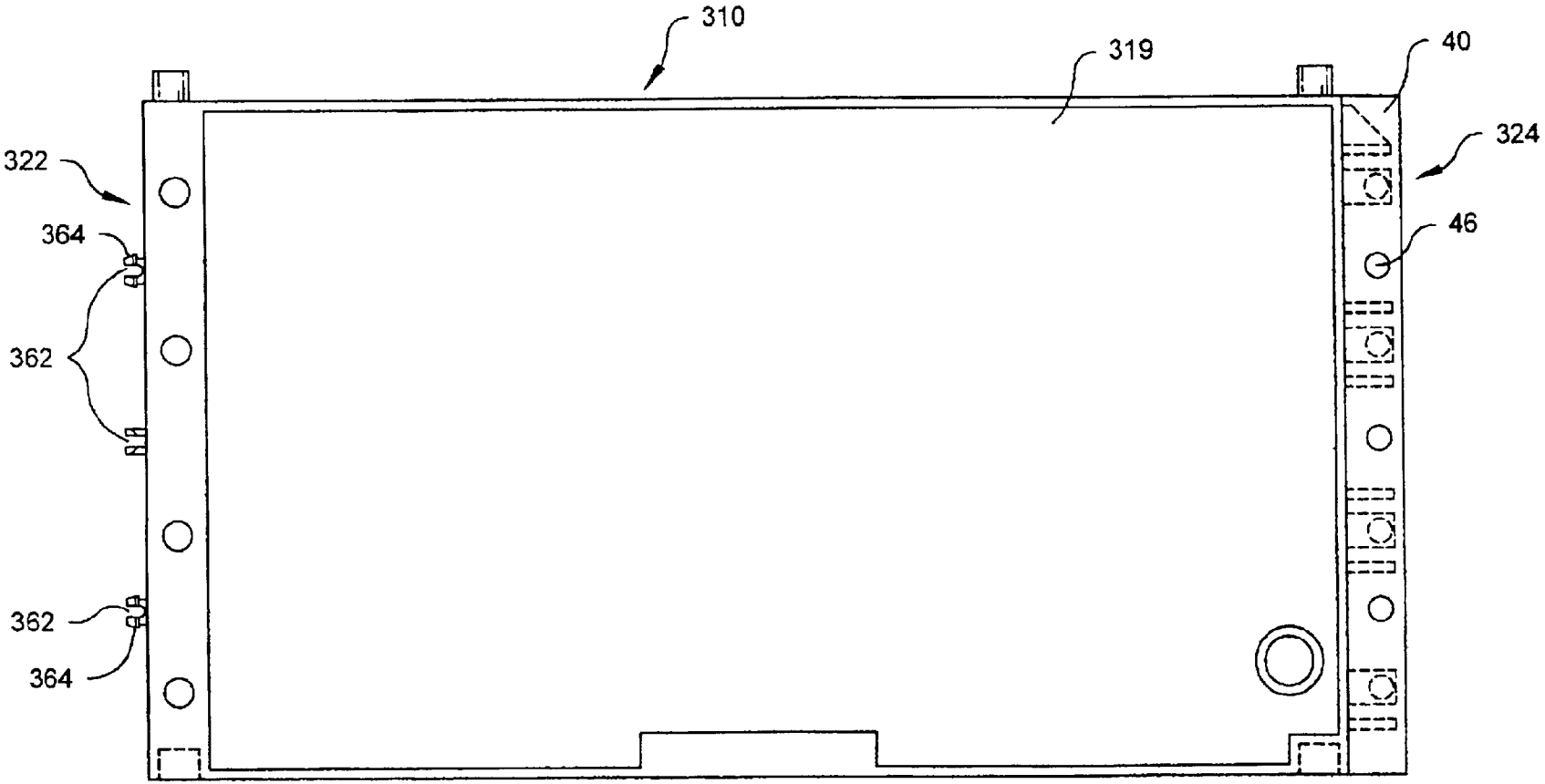
FIG. 16 is an elevational view of the inner major side of an integral panel in accordance with a third alternate embodiment of the present invention.

Referring to FIG. 16, a third alternate embodiment building unit 310 is shown which includes an integral panel 319 and a separate one of the elongate columns 40 (FIGS. 9 and 10). The integral panel 319 is essentially the integral panel 19 and connection member 50 of the preferred embodiment molded together as a single piece. The integral panel 319 has opposing outer and inner major sides connected by a first lateral side with a first connection structure 322, a second lateral side with a second connection structure 324, a top and a bottom. The column channel 42 receives and is engaged with the second connection structure 324 of the panel 319. The other three elongate sides 40*b*, 40*c*, 40*d* of the elongate column 40 each have female connection structures 46 to provide a female connection side to the building unit 310. The first connection structure 322 includes three pairs of second protrusions 362 like protrusions 62 of connection member 50, generally equally spaced from each other along the first connection structure 322. The three equally spaced second apertures 46 along each of three sides 40*b*, 40*c*, 40*d* of the elongate column 40 enable engagement with the three pairs of second protrusions 362 in any of the three sides 40*b*, 40*c*, 40*d* of the second connection structure 324. Again, the center-to-center spacing between any two adjacent second apertures 46 and pairs of protrusions 62 preferably is approximately three centimeters and the diameter of each second aperture 46 tapers down to between five and six and preferably about 5.5 millimeters.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy building construction set including a plurality of building units, each building unit comprising:

an integral panel having opposing outer and inner major sides connected by a first lateral side, an opposing second lateral side, a top, and an opposing bottom, the first lateral side having a first connection structure and the second lateral side having a second connection structure;

an elongate column having four elongate sides, one elongate side being open such that the other three elongate sides form a generally U-shaped channel of the column accessible along the one open side, the column channel receiving and being engaged with the second connection structure of the panel, at least one of the other three elongate sides of the elongate column having at least one female connection structure to provide a female connection side to the building unit; and a connection member having a first male side and a second male side, the first male side being engaged with the first connection structure of the panel and at least part of the second male side projecting outwardly from the panel to define at least one male connection structure and provide a male connection side to the building unit, the male connection structure being configured to releasably engage with any one of the female connection structures of the female connection side of a second building unit, thereby allowing interconnection of building units to construct a toy building.

2. The toy building construction set of claim 1 wherein at least a first building unit and a second building unit of the plurality of building units have panels of different widths between the first and second lateral sides.

3. The toy building construction set of claim 2 wherein the first building unit panel has a width generally equal to twice the width of a second building unit panel plus a width of one elongate column.

4. The toy building construction set of claim 3 wherein the width of the first building unit is about twenty-one centimeters and the width of the second building unit is about ten centimeters.

5. The toy building construction set of claim 1 wherein the first connection structure is an elongate channel within the first lateral side of the panel running from proximate the top of the panel to proximate the bottom, the panel channel being configured to accept and engage the first male side of the connection member.

6. The toy building construction set of claim 5 wherein the first male side of the connection member includes at least a first tab extending outwardly therefrom, the first tab having a first protrusion configured to engage with at least one mating first aperture along one side of the panel channel to lock the connection member within the panel channel.

7. The toy building construction set of claim 6 wherein the first male side of the connection member further includes at least a second tab extending therefrom, the second tab substantially encompassing a width of the panel channel to provide an interference fit whereby the connection member is essentially immobile in the panel.

8. The toy building construction set of claim 7 wherein the first male side includes four of the first tabs and the panel channel includes four of the mating first apertures.

9. The toy building construction set of claim 7 wherein the first male side further includes a plurality of second tabs.

10. The toy building construction set of claim 5 wherein the first male side of the connection member includes a plurality of the first tabs spaced apart and extending outwardly, the first tabs each having a first protrusion configured to engage with any of a like plurality of mating first apertures along one side of the panel channel so as to lock the connection member within the panel channel.

11. The toy building construction set of claim 10 wherein the first male side of the connection member further includes a plurality of second tabs extending therefrom, the second tabs substantially encompassing a width of the panel channel to provide an interference fit whereby the connection member is engaged with the panel channel such that the connection member is essentially immobile in the panel.

12. The toy building construction set of claim 11 wherein the first male side includes four first tabs and the panel channel includes four mating first apertures.

13. The toy building construction set of claim 11 wherein the first male side further includes six second tabs.

14. The toy building construction set of claim 1 wherein the second male side of the connection member includes at least one pair of second protrusions extending outwardly from a length of the connection member, each second protrusion being paired with and spaced from another second protrusion, each second protrusion being generally semicircular when viewed from a distal end, the at least one pair of second protrusions collectively being generally circular when viewed together from the distal end, the at least one pair of second protrusions having a barb on each second protrusion of the pair.

15. The toy building construction set of claim 14 wherein the at least one pair of second protrusions fits within a coinciding second aperture through one of the sides of the elongate column, the barb of the each of the second protrusions extending through the second aperture and engaging an inner side of the elongate column when the second male side of the connection member is in facing engagement with and abuts one of the sides of the elongate column, enabling locking engagement of the at least one pair of second protrusions within the coinciding at least one second aperture and the locking, engagement of the connection member with the elongate column.

16. The toy building construction set of claim 15 wherein the second male side of the connection member includes three pairs of second protrusions, adjacent pairs of the three pairs of second protrusions being equally spaced from one another.

17. The toy building construction set of claim 16 wherein the female connection structure of each elongate column includes three equally spaced second apertures along one of the other three elongate sides to enable equipment with the connection member in any of the other three elongate sides of the elongate column.

18. The toy building construction set of claim 17 wherein center-to-center spacing between any adjacent pair of the second apertures is approximately three centimeters.

19. The toy building construction set of claim 17 wherein each second aperture has a diameter of between five and six millimeters.

20. The toy building construction set of claim 1 wherein the second male side of the connection member includes a plurality of second protrusions spaced along a length of the connection member, each of the second protrusions being paired with and spaced from another of the second protrusions, each of the second protrusions being semicircular when viewed from a distal end, each pair of the second protrusions collectively being generally circular when viewed together from the distal end, at least one of the second protrusions of at least one pair having a barb, configured to engage with one of the second apertures.

21. The toy building construction set of claim 20 wherein each pair of the second protrusions fits within a coinciding second aperture through one of the sides of the elongate column, the barb of each of the second protrusions extending through the second aperture and engaging an inner side of the elongate column when the second male side of the connection member is in facing engagement with and abuts one of the sides of the elongate column, thereby enabling locking engagement of the pair of the second protrusions within the pair of coinciding second apertures and the locking engagement of the connection member with the elongate column.

22. The toy building construction set of claim 21 wherein the second male side of the connection member includes three pairs of the second protrusions, adjacent pairs of the three pairs of second protrusions being equally spaced from one another.

23. The toy building construction set of claim 22 wherein the elongate column includes three of the second apertures equally spaced along each of the other three elongate sides to enable engagement with the connection member in any of the other three elongate sides of the elongate column.

24. The toy building construction set of claim 23 wherein center-to-center spacing between any two adjacent second apertures is approximately three centimeters.

25. The toy building construction set of claim 23 wherein each second aperture has a diameter of between five and six millimeters.

26. The toy building construction set of claim 1 wherein the second connection structure of the panel includes at least a third tab extending outwardly therefrom, the third tab having a circular third protrusion positioned to engage with at least a mating third aperture along one side of the column channel, the circular third protrusion being configured to provide a locking engagement of the second connection structure within the column channel.

27. The toy building construction set of claim 26 wherein the second connection structure further includes at least a fourth tab extending therefrom, the fourth tab substantially encompassing a width of the column channel to provide an interference fit when the second connection structure is engaged with the column channel such that the second connection structure is essentially immobile in the elongate column.

28. The toy building construction set of claim 27 wherein the second connection structure of the panel includes four of the third tabs and the column channel includes four of the mating third apertures.

29. The toy building construction set of claim 27 wherein the second connection structure includes six of the fourth tabs.

30. The toy building construction set of claim 1 wherein the second connection structure of the panel includes a plurality of third tabs extending outwardly therefrom, the third tabs each having a circular third protrusion positioned to engage with a mating third aperture along one side of the column channel, the circular third protrusions being configured to provide a locking engagement of the second connection structure within the column channel.

31. The toy building construction set of claim 30 wherein the second connection structure further includes a plurality of fourth tabs extending therefrom, the fourth tabs substantially encompassing a width of the column channel to provide an interference fit when the second connection structure is engaged with the column channel such that the second connection structure is essentially immobile in the elongate column.

32. The toy building construction set of claim 30 wherein the second connection structure of the panel includes four of the third tabs and the column channel includes four of the mating third apertures.

33. The toy building construction set of claim 30 wherein the second connection structure includes six of the fourth tabs.

34. The toy building construction set of claim 2 further comprising at least one horizontal panel removably engageable with at least one of the top and bottom of the panel of at least one of the plurality of building units such that the at least one building unit makes up at least a part of a wall of the toy building and the horizontal panel makes up one of a floor and a ceiling of the toy building.

35. The toy building construction set of claim 34 wherein a top of the at least one building unit has a plurality of fourth protrusions configured to removably engage with at least some of a plurality of first openings in a bottom major side of the horizontal panel when the horizontal panel is used as a ceiling of the toy building.

36. The toy building construction set of claim 35 wherein the plurality of first openings in the bottom of the horizontal panel are arranged so as to engage with the plurality of fourth protrusions of the building unit, the building unit being one of a first and a second lengths between the first and second lateral side walls of each panel, the first length being longer than the second length.

37. The toy building construction set of claim 34 wherein a top major side of the horizontal panel has a plurality of fifth protrusions that removably engage within at least some of a plurality of second openings in a bottom of the at least one building unit when the horizontal panel is used as a floor of the toy building.

38. The toy building construction set of claim 37 wherein the plurality of fifth protrusions in the top major side of the horizontal panel are arranged so as to engage within the plurality of second openings of the building unit, the building unit being one of a first and a second lengths between the first and second lateral side walls of each panel, the first length being longer than the second length.

39. The toy building construction set of claim 1 wherein, for each building unit, the panel and the elongate column are made of different polymer materials.

40. The toy building construction set of claim 1 wherein, for each building unit, the panel and the connection member are made of different polymer materials.

41. The toy building construction set of claim 1 wherein, for each building unit, the elongate column and the connection member are made of different polymer materials.

42. The toy building construction set of claim 1 wherein, for each building unit, the panel, the elongate column, and the connection member are each made from polymer materials different from one another whereby each building unit is formed from three different polymer materials.

43. A toy building construction set including a plurality of building units, each building unit comprising an integral panel having opposing outer and inner major sides connected by a first lateral side, an opposing second lateral side, a top, and an opposing bottom, the first lateral side having a first connection structure, the second lateral side having a second connection structure;

wherein the first connection structure includes three pairs of second protrusions generally equally spaced from each other along a length of the first connection structure, each second protrusion being semicircular when viewed from a distal end, each pair of second protrusions collectively being generally circular when viewed together from the distal end, at least one pair of the second protrusions having a barb on each second protrusion of the pair;

wherein the second connection structure includes three generally equally spaced second apertures along at least one of three sides of the second connection structure to enable engagement with the three pairs of second protrusions in the at least one of three sides of the second connection structure; and wherein each pair of second protrusions of a first building unit fits within the coinciding second aperture of a second building unit through one of the sides of the second connection structure, the barb extending through the corresponding second aperture and engaging an inner side of the second connection structure when the second connection structure is in facing engagement with and abuts one of the sides of the first connection structure, enabling locking engagement of the pair of second protrusions within the coinciding second aperture and the locking engagement of the first building unit with the second building unit.

44. The toy building construction set of claim 43 wherein center-to-center spacing between any two adjacent second apertures is approximately three centimeters.

45. The toy building construction set of claim 43 wherein each second aperture has a diameter between five and six millimeters.

46. A toy building construction set including a plurality of building units, each building unit comprising:

an integral panel having opposing outer and inner major sides connected by a first lateral side, an opposing second lateral side, a top, and an opposing bottom, the first lateral side having a first connection structure, the second lateral side having a second connection structure;

a connection member having a first male side and a second male side, the first male side being engaged with the first connection structure of the panel and at least part of the second male side projecting outwardly from the panel to provide a male connection side to the building unit, the male connection side being configured to releasably engage with a female connection side of another building unit, the male connection side being configured to releasably engage with any of three female connection sides of other building units, thereby allowing the interconnection of the building units, the second male side includes three pairs of second protrusions generally equally spaced from each other along a length of the male connection side, each second protrusion being generally semicircular when viewed from a distal end, each pair of second protrusions collectively being generally circular when viewed together from the distal end, at least one pair of second protrusions having a barb on each second protrusion of the pair; and the second connection structure having three generally equally spaced second apertures along at least one of three sides of the second connection structure to enable engagement with the three pairs of second protrusions, each pair of second protrusions of the connection member engaged with a first building unit fits within the coinciding second aperture of a second connection structure of a second building unit through one of the sides of the second connection structure, the barbs of the second protrusion pair extending through the corresponding second aperture and engaging an inner side of the second connection structure when the second connection structure is in facing engagement with and abuts one of the sides of the connection member, enabling locking engagement of the pair of second protrusions within the coinciding second aperture and the locking engagement of the first building unit with the second building unit.

47. The toy building construction set of claim 46 wherein a spacing between any two adjacent second apertures is approximately three centimeters.

48. The toy building construction set of claim 46 wherein the diameter of each second aperture is approximately 5.5 millimeters.

49. A toy building construction set including a plurality of building units, each building unit comprising:

an integral panel having opposing outer and inner major sides connected by a first lateral side, an opposing second lateral side, a top, and an opposing bottom, the first lateral side having a first connection structure, the second lateral side having a second connection structure;

an elongate column having four elongate sides, one elongate side having open such that the other three elongate sides form a generally U-shaped channel of the column accessible along the one open side, the column channel receiving and being engaged with the second connection structure of the panel, the other three elongate sides of the elongate column each having female connection structures to provide a female connection side to the building unit;

wherein the first connection structure includes three pairs of second protrusions generally equally spaced from each other along a length of the first connection structure, each second protrusion being semicircular when viewed from a distal end, each pair of second protrusions collectively being generally circular when viewed together from the distal end, at least one pair of the second protrusions having a barb on each second protrusion of the pair;

wherein the elongate column includes three equally spaced second apertures along each of three sides of the elongate column to enable engagement with the three pairs of second protrusions in any of the three sides of the elongate column; and wherein each pair of second protrusions of the first connection structure of a first building unit fits within the coinciding second aperture of a second building unit through one of the sides of the elongate column, the barb extending through the corresponding second aperture and engaging an inner side of the elongate column when the first connection structure is in facing engagement with and abuts one of the sides of the elongate column, enabling locking engagement of the pair of second protrusions within the coinciding second aperture and the locking engagement of the first building unit with the second building unit.

50. The toy building construction set of claim 49 wherein center-to-enter spacing between any two adjacent second apertures is approximately three centimeters.

51. The toy building construction set of claim 49 wherein each second aperture has a diameter between five and seven millimeters.

* * * * *